United States Patent [19]

Rasmëssen

[11] 4,009,026

[45] Feb. 22, 1977

[54] STRONTIUM-SILICON-ALUMINUM MASTER ALLOY AND PROCESS THEREFOR

[75] Inventor: Robert T. C. Rasmëssen, Pottstown, Pa.

[73] Assignee: Kawecki Berylco Industries, Inc., Reading, Pa.

[22] Filed: Nov. 24, 1975

[21] Appl. No.: 634,333

Related U.S. Application Data

[63] Continuation-in-part of Ser. No. 500,893, Aug. 27, 1974, abandoned, which is a continuation-in-part of Ser. No. 488,667, July 15, 1974, abandoned.

[52] U.S. Cl. ..... 75/148; 75/68 R; 75/134 A; 75/134 S; 148/32

[51] Int. Cl.[2] ..... C22C 1/03

[58] Field of Search ..... 75/148, 134 A, 134 S, 75/68 R; 148/32

[56] References Cited

UNITED STATES PATENTS 3,567,429 3/1971 Dunkel et al. ..... 75/148

*Primary Examiner*—R. Dean

*Attorney, Agent, or Firm*—Pennie & Edmonds

[57] ABSTRACT

A strontium-silicon-aluminum master alloy for modifying the eutectic component of eutectic and hypo-eutectic aluminum-silicon casting alloys comprises 3 to 20 percent by weight strontium, 5 to 28 percent by weight silicon, each of said elements being present throughout the recited ranges, and the balance essentially aluminum. The master alloy is prepared by adding a strontium compound (e.g., a strontium silicide) to molten aluminum at a temperature of between about 1450° and 2100° F.

4 Claims, 7 Drawing Figures

STRONTIUM-SILICON-ALUMINUM MASTER ALLOY AND PROCESS THEREFOR

CROSS-REFERENCE TO RELATED APPLICATIONS

This is a continuation-in-part of application Ser. No. 500,893 filed Aug. 27, 1974, now abandoned, which is in turn a continuation-in-part of Ser. No. 488,667 filed July 15, 1974, now abandoned.

BACKGROUND OF THE INVENTION

This invention relates to master alloys and, more particularly to a master alloy for modifying the aluminum-silicon eutectic component of aluminum-silicon eutectic and hypo-eutectic casting alloys.

Strontium, either per se or in the form of a strontium-aluminum master alloy, is known to be a superior and permanent modifier of the aluminum-silicon eutectic in eutectic and hypo-eutectic (less than 12.6 weight percent of silicon) aluminum-silicon casting alloys. Modification of the aluminum-silicon eutectic results in enhanced properties of the alloys, such as increased tensile strength. Thus, according to U.S. Pat. No. 3,466,170, U.S. Pat. No. 3,567,429, Canadian Patent No. 829,816 and K. Alker et al., "Experiences with the Permanent Modification of Al-Si Casting Alloys," published in *Aluminum*, 48(5), 362–367 (1972), the use of alkaline earth metals (e.g., strontium) as modifiers for aluminum-silicon alloys improves the casting properties of the latter, especially when these alloys are at or near the eutectic composition, which is the composition at which the melting point of the alloy is at a minimum. However, the manufacture of such a master alloy, containing, for example, about 10 weight percent strontium and 90 percent aluminum, is subject to the disadvantage that the strontium metal added to molten aluminum to form the master alloy is not only expensive but also oxidizes when exposed to air and burns upon fusion in contact with molten aluminum in the ambient atmosphere. A need has therefore existed in the aluminum casting field for a strontium-containing master alloy which is free of the aforesaid drawbacks.

Accordingly, it is an object of the present invention to provide an improved strontium-containing master alloy for modifying the structure of eutectic and hypo-eutectic aluminum-silicon casting alloys.

Another object is to provide a process for producing an improved strontium-containing master alloy for modifying the structure of eutectic and hypo-eutectic aluminum-silicon casting alloys.

These and other objects of the present invention as well as a fuller understanding of the advantages thereof can be had by reference to the following detailed description and claims.

SUMMARY OF THE INVENTION

The foregoing objects are achieved according to the present invention wherein a strontium-silicon-aluminum master alloy equally as effective as the known strontium-aluminum master alloys on a per-unit strontium basis can be made by adding a strontium compound, particularly strontium silicide or strontium-silicon alloy, to molten aluminum. The thus-added strontium compound costs only a small fraction of the equivalent amount of strontium metal and furthermore does not appreciably oxidize during its incorporation into the molten aluminum in the ambient atmosphere.

The master alloy of this invention contains at least 3 weight percent strontium, the balance being made up of silicon and aluminum, although additional elements or incidental impurities can also be present, including, for example, calcium, iron, barium, manganese, titanium and zirconium.

Strontium-silicon alloys suitable for use in the present invention generally contain between about 15 and 60 weight percent strontium, between about 40 and 75 weight percent silicon, and the balance incidental impurities. For instance, strontium silicide, $SrSi_2$, a known compound, contains 61 weight percent strontium and 39 weight percent silicon. The preparation of strontium-silicon alloys containing up to 55 weight percent strontium is disclosed, for example in U.S. Pat. No. 3,374,086. As indicated in that prior patent, the term "incidental impurities" includes substances such as barium, iron, carbon and calcium; as used herein, the term is further intended to include these substances in minor amounts, i.e., such that the properties of the master alloy produced according to the process of the invention are not adversely affected. For example, a strontium-silicon alloy suitable for use in the practice of the present process can contain calcium in amounts ranging from 0.1 to 4 weight percent. A study of the structure of commercial strontium-silicon alloy by X-ray diffraction indicates that the strontium is present mainly in the form of $SrSi_2$. Strontium-silicon alloys containing less than 61 weight percent strontium are therefore characterized by a strontium content in the form of $SrSi_2$ together with excess Si.

A preferred strontium-silicon alloy for use in the present invention is a commercially available form containing between about 30 and 45 weight percent strontium, and between about 34 and 65 weight percent silicon. The resulting master alloy comprises strontium, silicon, and aluminum in which the strontium and silicon are present within the ranges of about 3 to 20 weight percent and preferably between about 7 and 15 weight percent of strontium, about 5 to 28 weight percent and preferably between about 8 and 21 weight percent of silicon, and the balance aluminum. The term "balance aluminum" is intended to include amounts of other elements which may be present, such as calcium, iron, barium, manganese, titanium and zirconium. These elements generally find their way into the master alloy through the incidental impurities contained in the strontium-silicon alloy. The term "minor amounts," as indicated previously, is intended to mean amounts which do not adversely affect the useful properties of the resulting master alloy. Thus, for example, calcium can be present in the master alloy in amounts varying from about 0.1 to 1 percent by weight. In some cases, the presence of calcium in amounts within the aforesaid ranges may improve the performance of the master alloy of the invention.

The master alloy is produced by adding to molten aluminum of conventional purity an appropriate amount of strontium silicide as described above, preferably a commercially available "strontium-silicon alloy" analyzing, for example, about 42 percent percent strontium, about 47 weight percent silicon, about 4 weight percent iron and about 1 weight percent calcium. The strontium-silicon alloy is added to molten aluminum maintained at between about 1450° and 2100° F, and preferably between about 1700° and 2000° F, in which it is incorporated with stirring, to form the master alloy of the present invention together with a relatively small amount of "slush," which is discarded.

The amount of strontium-silicon alloy added to the aluminum base is such as to yield a master alloy ranging in composition from about 3 weight percent strontium, 5 weight percent silicon, and the balance essentially aluminum (together with the aforesaid impurities), to about 20 weight percent strontium, 28 weight percent silicon, and the balance essentially aluminum and impurities.

As indicated above, additional elements can be present in the master alloy besides strontium, silicon and aluminum. However, only those other elements should be present which are of the types and in the amounts which do not interfere with the desired eutectic-modifying properties of the master alloy of the invention. In some cases, as indicated above, for example, calcium can be incorporated via the strontium-silicon alloy in amounts of from about 0.1 to 1 percent by weight.

The master alloys of the invention function as modifiers of the eutectic component of eutectic and hypoeutectic silicon-aluminum casting alloys by incorporation into the degassed melt prior to casting so as to provide a retained strontium content in the cast alloy as the end of the holding or incubation period of greater than about 0.005 weight percent and preferably at least about 0.008 weight percent.

DESCRIPTION OF THE DRAWINGS

Referring to the drawings.

Figure 1:
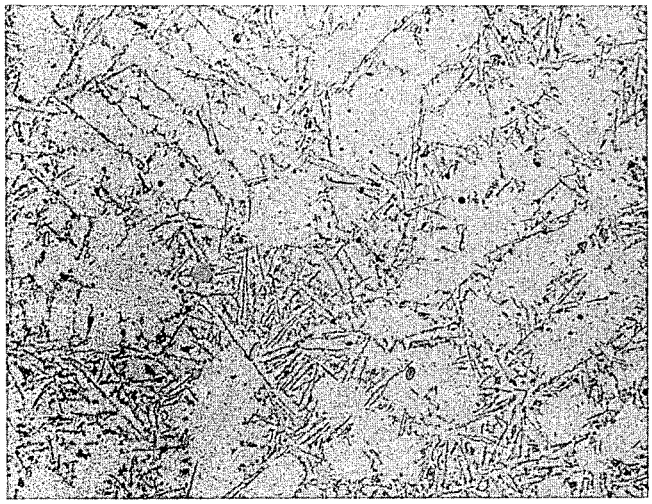
FIG. 1 is the photomicrograph of an unmodified conventional 10 percent silicon/90 percent aluminum casting alloy taken at a magnification of 200:1. The undesirable needle-like microcrystalline texture of the unmodified eutectic structure of this alloy is clearly discernible.
Figure 2A:
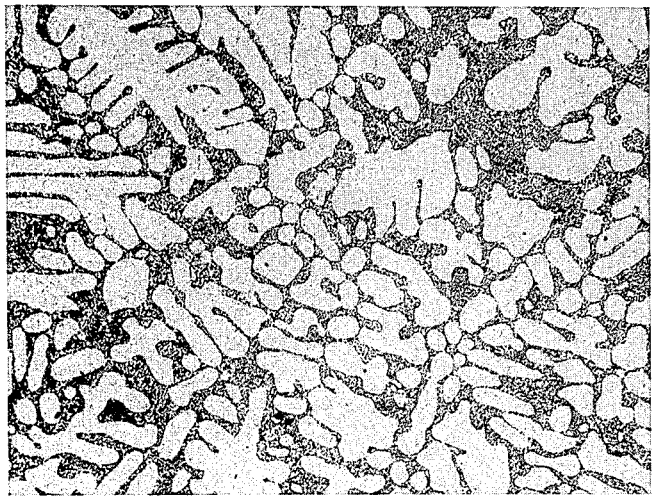
FIG. 2A is a photomicrograph (200x) of a conventional 10/90 silicon/aluminum casting alloy which has been modified with a 15 percent strontium/85 percent aluminum master alloy commonly used in the prior art to give a strontium content in the resulting alloy of 0.01 weight percent. The desirable microcrystalline texture of the modified eutectic structure of the alloy is clearly visible.
Figure 2B:
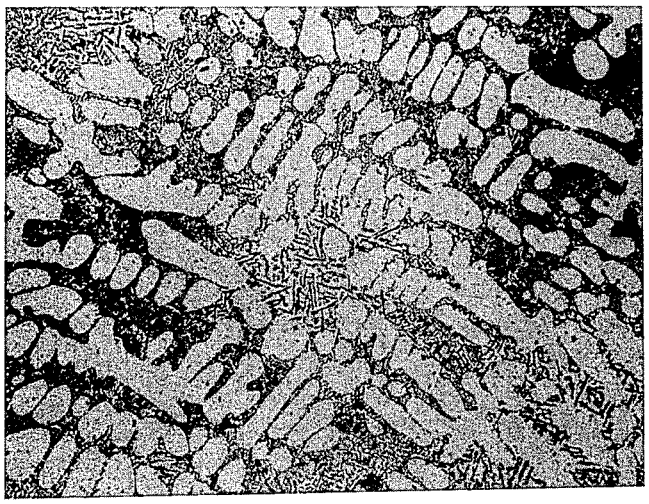
FIG. 2B is a photomicrograph (200x) of the modified silicon-aluminum alloy depicted in FIG. 2A which has been melted and resolidified once. The partial loss of grain-modification and reversion to the undesirable microcrystalline texture of the type shown in FIG. 1 is readily apparent.
Figure 2C:
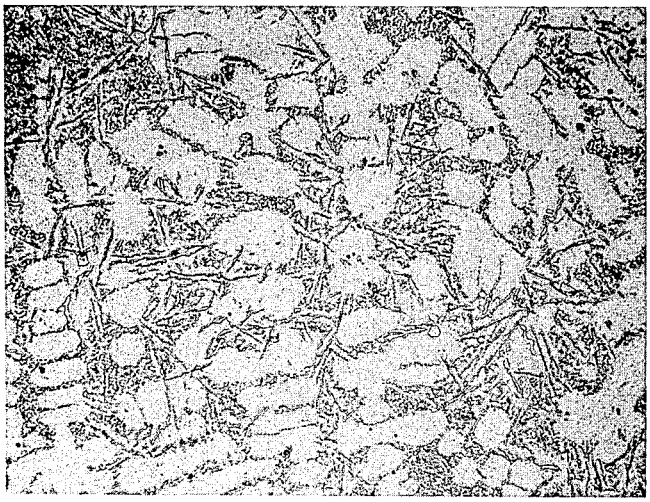
FIG. 2C is a photomicrograph (200x) of the modified silicon-aluminum alloy depicted in FIG. 2A which has been melted and resolidified twice. The substantially complete reversion of the microcrystalline structure of the alloy to that characteristic of the unmodified alloy shown in FIG. 1 is clearly illustrated.
Figure 3A:
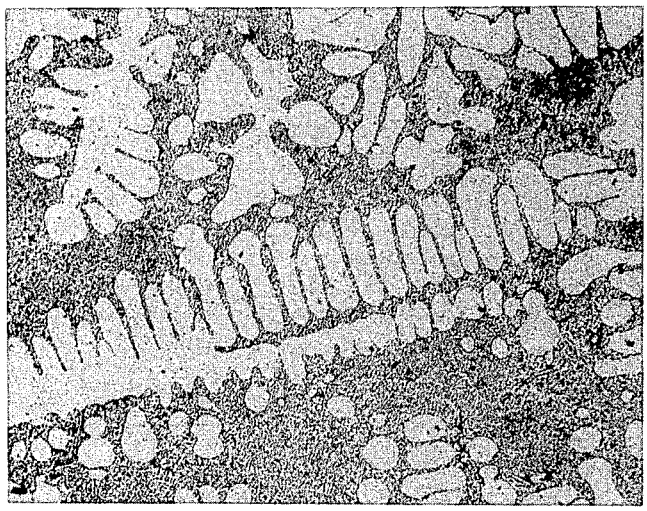
FIG. 3A is a photomicrograph (200x) of a 10/90 silicon-aluminum casting alloy which has been modified with the strontium-containing master alloy of the invention and which is similar to the one described in the example hereinbelow to give a strontium content in the alloy of 0.01 weight percent. The desirable microcrystalline texture of the modified grain structure is clearly visible.
Figure 3B:
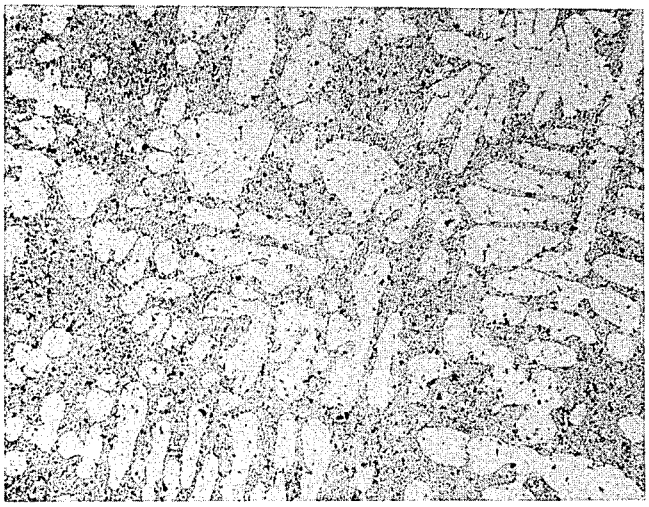
FIG. 3B is a photomicrograph (200x) of the modified silicon-aluminum alloy depicted in FIG. 3A which has been melted and solidified once. As can be seen in FIG. 3B, there is no detectable loss of modified eutectic structure upon such remelting.
Figure 3C:
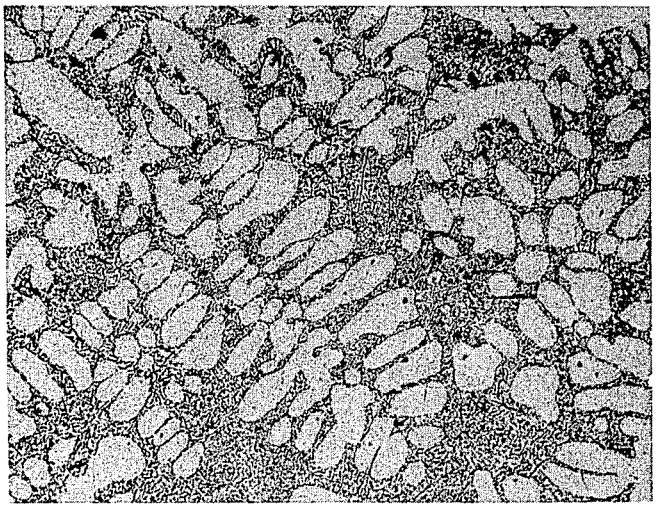
FIG. 3C is a photomicrograph (200x) of the modified silicon-aluminum alloy depicted in FIG. 3A which has been melted and resolidified twice. As can be seen in FIG. 3C, there is still no detectable loss of modified eutectic structure as a result of such two-fold remelting.

A comparison of the results of the two-fold meltings and solidification depicted in FIGS. 2C and 3C illustrates an advantage of the master alloy of the present invention over conventional strontium-aluminum master alloys in that the present master alloy provides a superior degree of persistence of modification with repeated melting and solidification of the modified casting alloy.

DESCRIPTION OF THE PREFERRED EMBODIMENT

Example

As an example of a preferred master alloy composition of the present invention and the process for making it, 30 parts by weight of the aforementioned commercially available strontium-silicon alloy are added to 70 parts by weight molten aluminum at a temperature of about 1850° F. The strontium-silicon alloy readily dissolves in the aluminum and the homogeneity of the mixture is assured by means of gentle stirring. The resulting strontium-aluminum-silicon master alloy (94 parts recovered) has the following composition: about 9.4 weight percent strontium, about 13.9 weight percent silicon and the balance aluminum and various impurities of the types mentioned above. Along with the master alloy there is formed a quantity (6 parts by weight) of slush, which is discarded.

The foregoing description is presented for the purpose of illustrating, without limitation, the product and process of the present invention. It is understood that changes and variations can be made therein without departing from the spirit and scope of the invention as defined in the following claims.

I claim:

1. A process for producing a master alloy for adding a modifying amount of strontium to eutectic and hypoeutectic aluminum-silicon alloys, said process comprising adding a strontium-silicon alloy consisting essentially of:

a. between about 15 and 60 weight percent strontium;

b. between about 40 and 75 weight percent silicon; and c. the balance incidental impurities to substantially pure aluminum at a temperature of between about 1450° and 2100° F, said strontium-silicon alloy being added in an amount to produce a strontium-silicon-aluminum master alloy containing:

a'. between about 3 and 20 weight percent strontium;

b'. between about 5 and 28 weight percent silicon; and c'. the balance aluminum and impurities.

2. A process according to claim 1 wherein the strontium-silicon alloy consists essentially of between about 30 and 45 weight percent strontium, between about 34 and 65 weight percent silicon, and the balance incidental impurities;

the strontium-silicon alloy is added to the aluminum at a temperature of between about 1700° and 2000° F; and the strontium-silicon alloy is added to the aluminum in an amount to produce a master alloy consisting essentially of between about 7 and 15 weight percent strontium, between about 8 and 21 weight percent silicon, and the balance aluminum.

3. A process for producing a master alloy for adding a modifying amount of strontium to eutectic and hypoeutectic aluminum-silicon alloys, said process comprising adding a strontium-silicon alloy consisting essentially of:

a. between about 15 and 60 weight percent strontium;

b. between about 40 and 75 weight percent silicon;

c. minor amount of calcium; and d. the balance incidental impurities to substantially pure aluminum at a temperature of between about 1450° and 2100° F, said strontium-silicon alloy being added in an amount to produce a strontium-silicon-aluminum master alloy consisting essentially of:

a'. between 3 and 20 weight percent strontium;

b'. between about 5 and 28 weight percent silicon;

c'. between about 0.1 and 1 weight percent calcium; and the balance aluminum plus impurities.

4. A process according to claim 3 wherein:

the strontium-silicon alloy consists essentially of between about 30 and 45 weight percent strontium, between about 34 and 65 weight percent silicon, a minor amount of calcium, and the balance incidental impurities, the strontium-silicon alloy is added to the aluminum at a temperature of between about 1700° and 2000° F; and the strontium-silicon alloy is added to the aluminum in an amount to produce a master alloy containing between about 7 and 15 weight percent strontium, between about 8 and 21 weight percent silicon, between about 0.1 and 1 weight percent calcium and the balance aluminum.

* * * * *

UNITED STATES PATENT AND TRADEMARK OFFICE

CERTIFICATE OF CORRECTION

PATENT NO. : 4,009,026

DATED : February 22, 1977

INVENTOR(S) : ROBERT T. C. RASMUSSEN

It is certified that error appears in the above-identified patent and that said Letters Patent are hereby corrected as shown below:

Cover sheet of patent, (two places (19) and (75)), the inventor's name is misspelled. "Rasmessen" should read -- Rasmussen -- .

Column 3, line 24, "as" should read -- at -- .

Signed and Sealed this

Tenth Day of May 1977

[SEAL]

*Attest:*

RUTH C. MASON
*Attesting Officer*

C. MARSHALL DANN
*Commissioner of Patents and Trademarks*